US005465741A

United States Patent [19]

Dvorak

[11] Patent Number: 5,465,741

[45] Date of Patent: Nov. 14, 1995

[54] HAIR WRAP DEVICE

[76] Inventor: Sherry L. Dvorak, 12 Terilyn Dr., Jackson, Tenn. 38305

[21] Appl. No.: 217,729

[22] Filed: Mar. 25, 1994

[51] Int. Cl.[6] ..... A45D 8/00; A45D 8/34

[52] U.S. Cl. ..... 132/275; 132/273; 28/41

[58] Field of Search ..... 132/273, 274, 132/275, 222; D28/39, 41

[56] References Cited

U.S. PATENT DOCUMENTS

| | | | |
|---|---|---|---|
| D. 205,829 | 9/1966 | Gettinger | 132/274 X |
| D. 313,485 | 1/1991 | Malouf | D28/41 |
| 1,616,800 | 2/1927 | Hogan | 132/274 |
| 1,656,136 | 1/1928 | Boecklen | 132/222 |
| 2,007,895 | 7/1935 | Kayn | 132/274 |
| 2,800,910 | 7/1957 | Seyffarth | 132/222 |
| 5,167,245 | 12/1992 | Harriett | 132/273 |

FOREIGN PATENT DOCUMENTS

| | | | |
|---|---|---|---|
| 391590 | 5/1933 | United Kingdom | 132/222 |
| 472610 | 9/1937 | United Kingdom | 132/222 |

*Primary Examiner*—John G. Weiss
*Attorney, Agent, or Firm*—Michael I. Kroll

[57] ABSTRACT

A hair wrap device is provided for a ponytail on a head of a woman which consists of a structure for covering the ponytail. A component is for attaching a top portion of the covering structure to the ponytail. An element is for wrapping the rest of the covering structure about the ponytail.

5 Claims, 2 Drawing Sheets

HAIR WRAP DEVICE

BACKGROUND OF THE INVENTION

1. Field of the Invention

The instant invention relates generally to women's hairstyling equipment and more specifically it relates to a hair wrap device.

2. Description of the Prior Art

Numerous women's hairstyling equipment have been provided in prior art that are adapted to be applied to the hair for achieving a particular type of hairdo or coiffure. While these units may be suitable for the particular purpose to which they address, they would not be as suitable for the purposes of the present invention as heretofore described.

SUMMARY OF THE INVENTION

A primary object of the present invention is to provide a hair wrap device that will overcome the shortcomings of the prior art devices.

Another object is to provide a hair wrap device that is a piece of flexible material placed over and secured to a ponytail on a woman's head and an attached lace, which is wrapped about the piece of flexible material and the ponytail, thereby forming a new fashion accessory.

An additional object is to provide a hair wrap device that adds another item to be utilized as a woman's hair accessory.

A further object is to provide a hair wrap device that is simple and easy to use.

A still further object is to provide a hair wrap device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
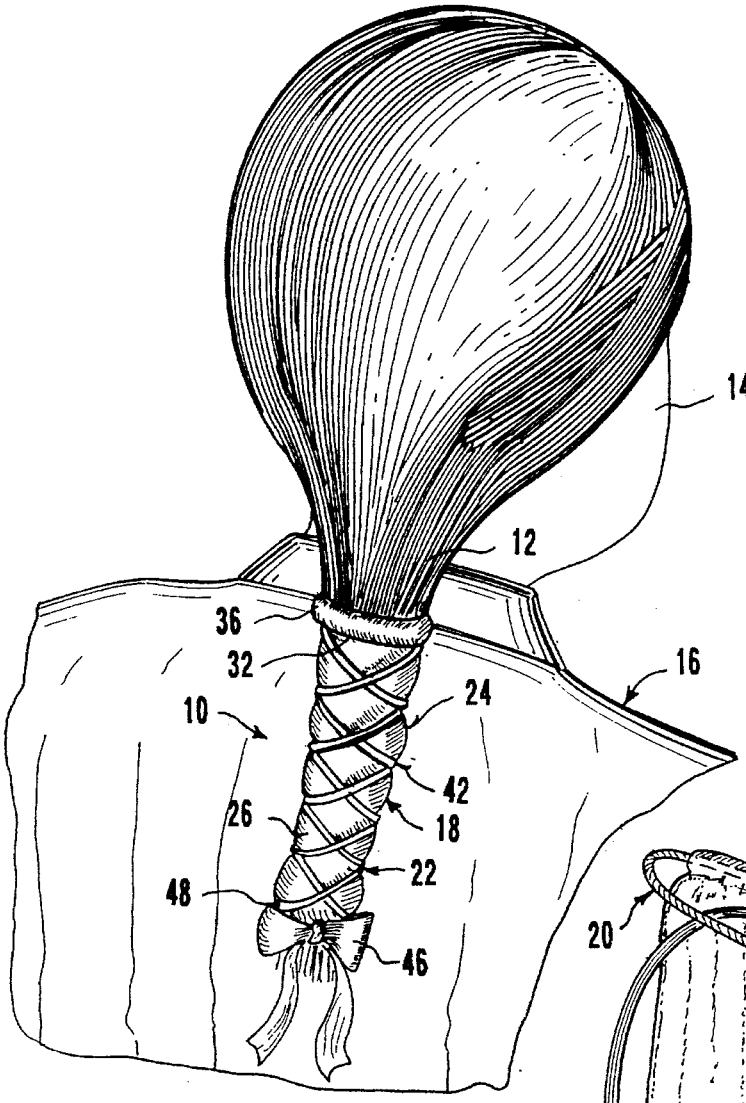
FIG. 1 is a front perspective view of the instant invention worn on a ponytail of a woman.
Figure 2:
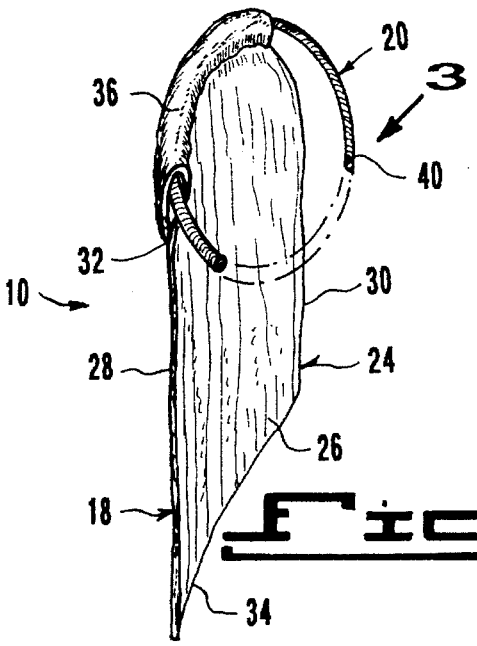
FIG. 2 is a rear perspective view of the instant invention per se, with the elastic band broken away and the lace removed therefrom.
Figure 3:
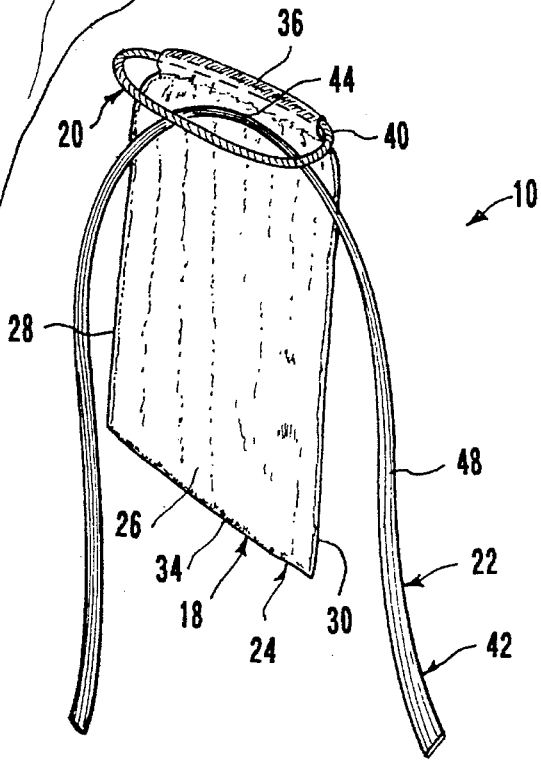
FIG. 3 is a rear perspective view of the first embodiment per se taken in the direction of arrow 3 in FIG. 2, with the lace attached thereto.

Turning now descriptively to the drawings, in which similar reference characters denote similar elements throughout the several views, FIGS. 1 through 8 illustrate a hair wrap device 10 for a ponytail 12 on a head 14 of a woman 16, which consists of a structure 18 for covering the ponytail 12. A component 20 is for attaching a top portion of the covering structure 18 to the ponytail 12. An element 22 is for wrapping the rest of the covering structure 18 about the ponytail 12.

The covering structure 18 is a thin piece of flexible material 24. The thin piece of flexible material 24 is a fabric sheet 26. The fabric sheet 26 is a rectangular, having two opposite long sides 28, 30 and two opposite short sides 32, 34, so as to be of size to fit over the length of the ponytail 12.

Figure 5:
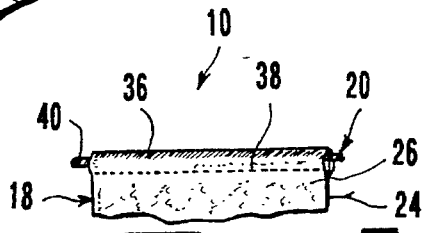
FIG. 5 is a front view of an upper portion of the piece of flexible material, showing a segment of the elastic band extending through the heading.
Figure 6:
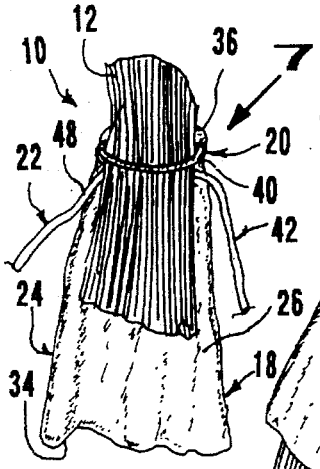
FIG. 6 is a rear perspective view showing the ponytail being extended through the elastic band.
Figure 7:
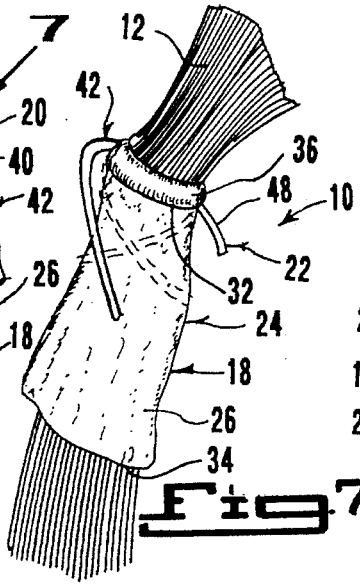
FIG. 7 is a front perspective view taken in the direction of arrow 7 in FIG. 6, with the ponytail in position and the lace ready to be wrapped about the piece of flexible material.
Figure 8:
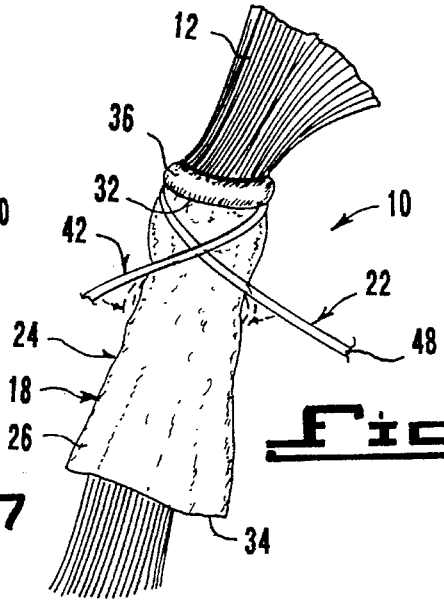
FIG. 8 is a front perspective view similar to FIG. 7, showing the lace starting to be wrapped about the piece of flexible material.

The fabric sheet 26 includes a heading 36 across the first short side 32 thereof. The heading 36 is fabricated by folding over the first short side 32 of the fabric sheet 26 and then sewn together by thread stitching 38 thereacross, as shown in FIG. 5. The attaching component 20 is an elastic band 40 that extends through the heading 36 to engage with the ponytail 12, so that the fabric sheet 26 can hang down therefrom.

The wrapping element 22 includes an elongated lace member 42. A fastener 44 is for affixing the lace member 42 at its mid point location to a back surface of the fabric sheet 26 directly below the center of the heading 36. The lace member 42 can be wrapped around the fabric sheet 26 and the ponytail 12, to form a bow 46 at the second short side 34 of the fabric sheet 26. The lace member 42 is a ribbon 48, made of a narrow strip of cloth material.

Figure 4:
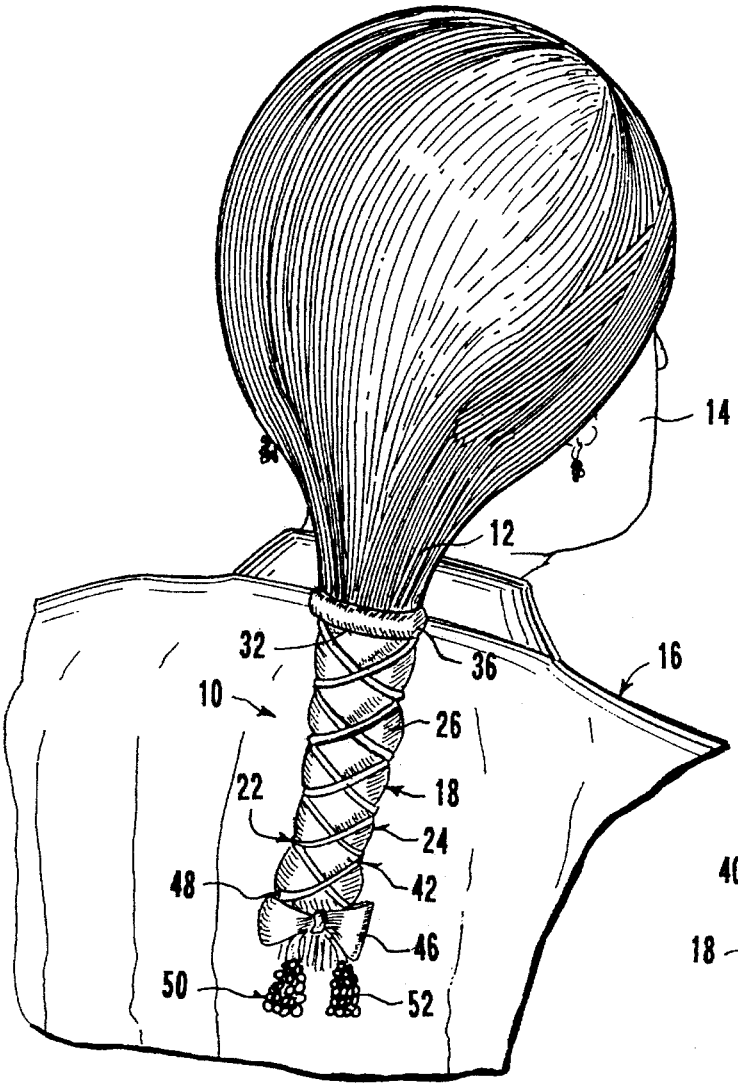
FIG. 4 is a front perspective view similar to FIG. 1, showing beads on the distal ends of the lace which can match with earrings.

The lace member 42 can include a pair of decorative articles 50, as shown in FIG. 4, with each attached to a distal free end thereof. When the bow 46 is formed, the decorative articles 50 will hang down therefrom. Each decorative article 50 includes a plurality of beads 52 as shown. Other types such as various jewels and other geometric shapes can also be utilized.

The lace member 42 is approximately four times the length of the fabric sheet 26. The fabric sheet 26 can be made in two basic sizes for different length ponytails 12. The first size of the fabric sheet 26 is three inches wide by four inches in length. The lace member 42 is sixteen inches in length and has a four inch wrap thereabout. The second size of the fabric sheet is four inches wide by six inches in length. The lace member 42 is now twenty-four inches in length and now has a six inch wrap thereabout.

The fabric sheet 26 can be made in different colors and materials, such as cotton, nylon, wool and similar articles. The lace member 42 can also be made in different colors and materials. The fabric sheet 26 and the lace member 42 can match or be different, depending upon the taste of the woman buying the hair wrap device 10.

OPERATION OF THE INVENTION

To apply the hair wrap device 10 to the ponytail 12, the following steps should be taken:

1. Choose the right size fabric sheet 26 for the length of the ponytail 12.
2. Slip the elastic band 40 onto the ponytail 12 until it is in the proper position.

Take the lace member 42 and wrap it in across over pattern about the fabric sheet 26 and the ponytail 12.

4. Tie the bow 46 at the second short side 34 of the fabric sheet 26.

To remove the hair wrap device 10 from the ponytail 12, the following steps should be taken:

1. Untie the bow 46 at the second short side 34 of the fabric sheet 26.
2. Unwrap the lace member 42 from about the fabric sheet 26 and the ponytail 12.
3. Slip the elastic band 40 off of the ponytail 12.
4. Store the hair wrap device 10 in a safe place until it is needed again.

LIST OF REFERENCE NUMBERS

| | |
|---|---|
| 10 | hair wrap device |
| 12 | ponytail |
| 14 | head |
| 16 | woman |
| 18 | covering structure |
| 20 | attaching component |
| 22 | wrapping element |
| 24 | thin piece of flexible material for 18 |
| 26 | fabric sheet for 24 |
| 28 | first long side of 26 |
| 30 | second long side of 26 |
| 32 | first short side of 26 |
| 34 | second short side of 26 |
| 36 | heading |
| 38 | thread stitching |
| 40 | elastic band for 20 |
| 42 | lace member for 22 |
| 44 | fastener |
| 46 | bow |
| 48 | ribbon for 42 |
| 50 | decorative article |
| 52 | beads for 50 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hair wrap device for a ponytail on a head of a woman which comprises:

a) means for covering the ponytail, said covering means being a thin piece of flexible material, said thin piece of flexible material being a fabric sheet, said fabric sheet being rectangular having two opposite long sides and two opposite short sides, so as to be of a size to fit over the length of the ponytail, said fabric sheet including a heading across said first short side thereof, said heading being fabricated by folding over said first short side of said fabric sheet and then sewn together by thread stitching thereacross;

b) means for attaching a top portion of said covering means to the ponytail, said attaching means being an elastic band that extends through said heading to engage with the ponytail, so that said fabric sheet can hang down therefrom; and c) means for wrapping the rest of said covering means about the ponytail, said wrapping means including an elongated lace member, and means for affixing said lace member at its mid point location to a back surface of said fabric sheet directly below the center of said heading, so that said lace member can be wrapped around said fabric sheet and the ponytail to form a bow at said second short side of said fabric sheet.

2. A hair wrap device as recited in claim 1, wherein said lace member is a ribbon made of a narrow strip of cloth material.

3. A hair wrap device as recited in claim 2, wherein said lace member includes a pair of decorative articles, each attached to a distal free end thereof, so that when the bow is formed said decorative articles will hang down therefrom.

4. A hair wrap device as recited in claim 3, wherein each said decorative article includes a plurality of beads.

5. A hair wrap device as recited in claim 4, wherein said lace member is approximately four times the length of said fabric sheet.

* * * * *